US011655805B2

(12) United States Patent
Hou et al.

(10) Patent No.: US 11,655,805 B2
(45) Date of Patent: May 23, 2023

(54) ULTRA-LONG STROKE MULTI-CYLINDER RECIPROCATING PUMP

(71) Applicant: Southwest Petroleum University, Chengdu (CN)

(72) Inventors: Yongjun Hou, Chengdu (CN); Yuwen Wang, Chengdu (CN); Pan Fang, Chengdu (CN); Lei Du, Chengdu (CN)

(73) Assignee: Southwest Petroleum University, Chengdu (CN)

( * ) Notice: Subject to any disclaimer, the term of this patent is extended or adjusted under 35 U.S.C. 154(b) by 531 days.

(21) Appl. No.: 16/937,181

(22) Filed: Jul. 23, 2020

(65) Prior Publication Data

US 2021/0079901 A1 Mar. 18, 2021

(30) Foreign Application Priority Data

Sep. 13, 2019 (CN) ..... 201910867603.4

(51) Int. Cl.

| | |
|---|---|
| ***F04B 35/01*** | (2006.01) |
| ***F04B 1/16*** | (2006.01) |
| ***F04B 1/02*** | (2006.01) |
| ***F04B 1/124*** | (2020.01) |
| ***F04B 1/128*** | (2020.01) |
| ***F04B 1/143*** | (2020.01) |
| ***F04B 17/03*** | (2006.01) |
| ***F04B 17/05*** | (2006.01) |
| ***F04B 53/00*** | (2006.01) |

(Continued)

(52) U.S. Cl.

CPC ..... *F04B 1/16* (2013.01); *F04B 1/02* (2013.01); *F04B 1/124* (2013.01); *F04B 1/128* (2013.01); *F04B 1/143* (2013.01); *F04B 17/03* (2013.01); *F04B 17/05* (2013.01); *F04B 23/06* (2013.01); *F04B 53/006* (2013.01); *F04B 53/10* (2013.01); *F04B 53/146* (2013.01); *F04B 53/147* (2013.01); *F04B 53/162* (2013.01)

(58) Field of Classification Search

CPC ..... F04B 9/00; F04B 53/006; F04B 39/0094; F04B 41/06; F04B 23/06; F04B 35/01

USPC ..... 74/22 R, 22 A, 25, 55, 30, 31

See application file for complete search history.

(56) References Cited

U.S. PATENT DOCUMENTS 1,579,975 A * 4/1926 Tunison ..... F04B 47/02 74/29
2,502,057 A * 3/1950 Mitchell ..... F04B 9/02 74/29

FOREIGN PATENT DOCUMENTS

CN 103644167 A * 3/2014
CN 208772776 U * 4/2019

* cited by examiner

*Primary Examiner* — Thomas Fink
(74) *Attorney, Agent, or Firm* — Renner, Otto, Boisselle & Sklar, LLP

(57) ABSTRACT

An ultra-long stroke multi-cylinder reciprocating pump comprises a small gear, a large gear, a crankshaft, connecting rods, fixed racks, a frame, translation pinions, movable racks, clamps, piston rods, cylinder sleeves, pistons, suction valves, liquid discharging valves, guide rails, a prime motor, a coupling, and a small gear shaft. When the prime motor rotates, the small gear is meshed with the large gear to drive the crankshaft to rotate, an axial center of the translation pinion is driven by the connecting rod to move reciprocally, the translation pinion is meshed with the fixed rack and the movable rack simultaneously, and a distance of reciprocating motion of the movable rack is twice a distance of reciprocating motion of a rotation center of the translation pinion, so that an ultra-long stroke is realized.

9 Claims, 2 Drawing Sheets

(51) Int. Cl.

| | |
|---|---|
| ***F04B 53/10*** | (2006.01) |
| ***F04B 53/14*** | (2006.01) |
| ***F04B 53/16*** | (2006.01) |
| ***F04B 23/06*** | (2006.01) |

ULTRA-LONG STROKE MULTI-CYLINDER RECIPROCATING PUMP

TECHNICAL FIELD

The invention belongs to the technical field of reciprocating pumps, and specifically, to an ultra-long stroke multi-cylinder reciprocating pump.

BACKGROUND

The reciprocating pump of a conventional crank connecting rod mechanism is short in stroke, high in stroke frequency, large in vibration impact, high in working noise and short in sealing life of the piston. Increasing the stroke of the reciprocating pump and reducing the stroke frequency can obviously improve the performance of the reciprocating pump, reduce the working noise, and prolong the sealing life of the piston. However, long stroke can be achieved only by increasing a radius of the crank. With the increase of the radius of the crank, the processing difficulty of the crankshaft of the multi-cylinder reciprocating pump increases, and the structural size and weight of the reciprocating pump increase significantly. At present, the maximum stroke of the reciprocating pump of the crank connecting rod mechanism is only 16" (406.4 mm).

The hydraulic driven reciprocating pump can realize ultra-long stroke, but a high-power high-pressure hydraulic pump station needs to be arranged, leading to a low efficiency of the reciprocating pump system. In addition, phase detection and a complex hydraulic control system need to be configured among multiple cylinders, reducing the reliability and cost effectiveness of the reciprocating pump. At present, the hydraulic driven reciprocating pump has not been widely applied.

A reciprocating pump driven by a linear motor can realize ultra-long stroke in principle, but phase detection and a complex linear motor control system need to be configured among multiple cylinders. In addition, the linear motor is low in efficiency due to its working principle. At present, the reciprocating pump driven by a high-power linear motor has not been applied.

The reciprocating pump of the crank connecting rod mechanism is still widely used in various fields of industry. In order to overcome the defects of short stroke and high stroke frequency of the reciprocating pumps of the conventional crank connecting rod mechanism, the present disclosure particularly provides an ultra-long stroke multi-cylinder reciprocating pump.

SUMMARY

The present disclosure is intended to provide an ultra-long stroke multi- cylinder reciprocating pump which can not only overcome the disadvantages of short stroke and high stroke frequency of the reciprocating pump of the conventional crank connecting rod mechanism, but also give full play to the advantages of reliable reversing and stable phase among multiple cylinders. The pump may have one or more of the advantages of a long stroke, reliable phase control, high volume efficiency, good suction performance, small impact load, long service life, small discharge liquid pressure fluctuation, small pump and pipeline vibration, and low working noise, and can realize low-stroke large-displacement pumping of liquid.

The technical solution adopted by the disclosure is as follows:

An ultra-long stroke multi-cylinder reciprocating pump includes a small gear, a large gear, a crankshaft, connecting rods, fixed racks, a frame, translation pinions, movable racks, clamps, piston rods, cylinder sleeves, pistons, suction valves, liquid discharging valves, guide rails, a prime motor, a coupling, and a small gear shaft.

The small gear is fixedly mounted on the small gear shaft, the large gear is fixedly mounted on the crankshaft, one end of the connecting rod is connected with the crankshaft, the other end of the connecting rod is connected with a rotation center of the translation pinion, the fixed rack, the guide rail and the cylinder sleeve are all fixed on the frame, the translation pinion is mounted in the guide rail and movable along the guide rail, one end, close to the cylinder sleeve, of the movable rack is connected with the piston rod through the clamp, the piston rod is fixedly connected with the piston, the prime motor is fixed on the frame, and an output shaft of the prime motor is connected with the small gear shaft through the coupling.

A fixed rack and a movable rack are parallel to each other and are both meshed with a translation pinion, the movable rack is parallel to an axis of the cylinder sleeve, and the rotation center of the translation pinion and a rotation center of the crankshaft adopt a centering type arrangement or an offset type arrangement.

When the prime motor rotates, the small gear shaft and the small gear are driven to rotate, the small gear is meshed with the large gear, rotation power of the small gear shaft is decelerated and then transmitted to the large gear, the crankshaft is driven to rotate, an axial center of the translation pinion is driven to move reciprocally through the connecting rod, and the translation pinion drives the movable rack and the piston to move reciprocally; when the piston moves towards the opening side of the cylinder sleeve, the liquid discharging valve is closed, the suction valve is opened, and liquid enters the cylinder sleeve; when the piston moves towards the closing side of the cylinder sleeve, the suction valve is closed, the liquid discharging valve is opened, and the liquid is pressurized and then discharged out of the cylinder sleeve.

A distance of reciprocating motion of the rotation center of the translation pinion is directly proportional to the radius of the crankshaft. In the centering type arrangement, the distance is twice a radius of the crank; when a center of the translation pinion moves, the fixed rack is meshed with the gear teeth on an upper part of the translation pinion to form a speed instantaneous center, an instantaneous speed of a meshing part of a lower part of the translation pinion with the movable rack is twice of that of the rotation center of the translation pinion, so that the distance of reciprocating motion of the movable rack is twice the distance of reciprocating motion of the rotation center of the translation pinion. Therefore, a stroke of the piston is four times the radius of the crankshaft, so that the stroke of the reciprocating pump reaches an ultra-long stroke that is twice the stroke of a reciprocating pump of a conventional crank connecting rod mechanism with the same crankshaft radius.

A plurality of identical cylinder sleeves, pistons, piston rods, clamps, movable racks, translation pinions, fixed racks, connecting rods, suction valves and liquid discharging valves are used, and the crankshaft is configured into a same number of crank throws, so that the ultra-long stroke multi-cylinder reciprocating pump with double cylinders, three cylinders, five cylinders or more cylinders is formed.

In summary, after the foregoing technical solution is used, the present disclosure has the following beneficial effects: While the radius of the crank is not increased, the stroke of the piston is twice that of the reciprocating pump of the conventional crank connecting rod mechanism. This not only fully utilizes the advantages of the reciprocating pump of the conventional crank connecting rod mechanism such as convenient and reliable reversing and phase control, but also realizes the ultra-long stroke of the reciprocating pump so that liquid can be pumped with a large displacement and a low stroke frequency. The long stroke increases the volume efficiency and suction performance. The low stroke frequency prolongs the fatigue life of key parts. The piston, the suction valve and the liquid discharging valve are subject to small impact load and have longer service life. The low pressure fluctuation of the discharged liquid reduces the vibration of the pump and the pipeline and the working noise.

BRIEF DESCRIPTION OF THE DRAWINGS

In order to more clearly illustrate the technical solutions of the embodiments of the present disclosure, the drawings that need to be used in the embodiments are briefly described below. It is to be understood that the following drawings illustrate only certain embodiments of the present disclosure and are therefore not to be construed as a limitation to its scope. For those skilled in the art, other related drawings may be derived from the drawings without involving any creative effort.

Figure 1:
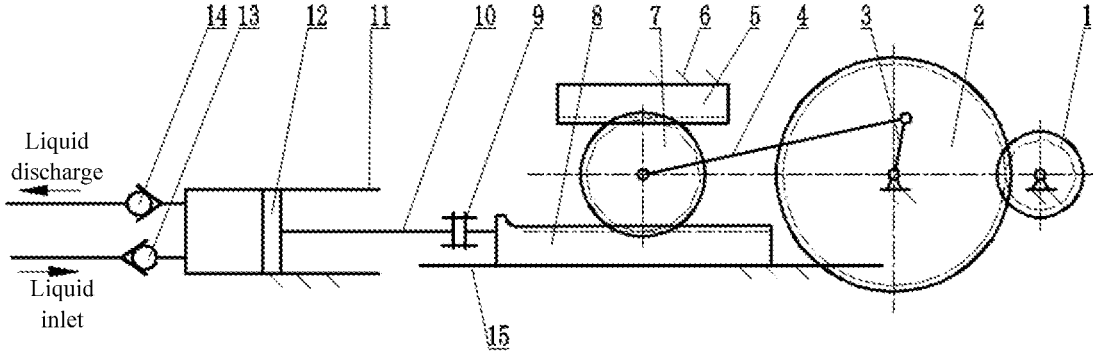
FIG. 1 is a schematic view showing a principle of a centering type arrangement of an ultra-long stroke multi-cylinder reciprocating pump according to the present disclosure.
Figure 2:
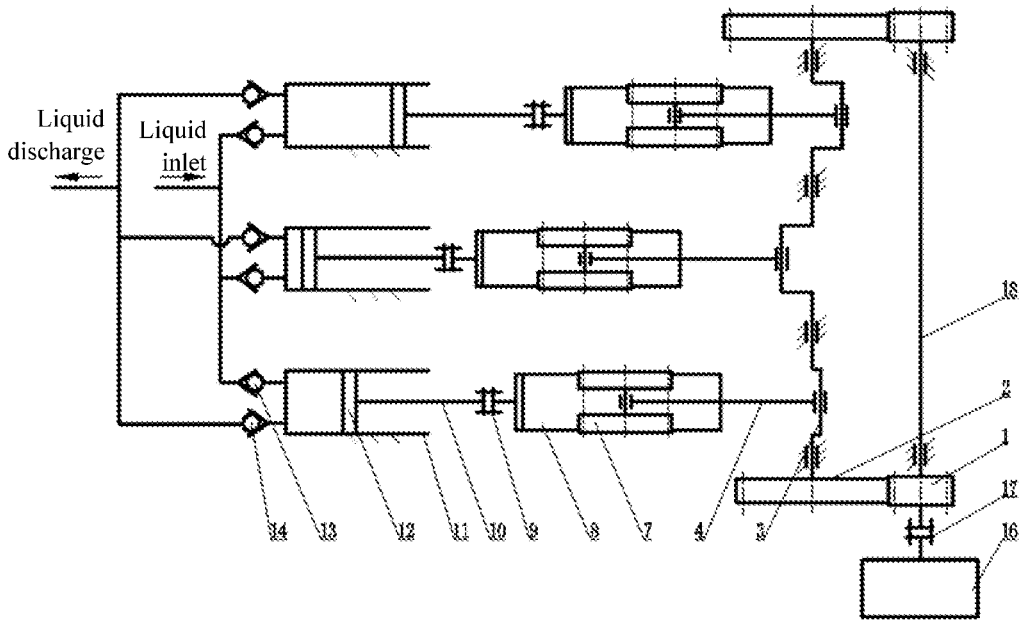
FIG. 2 is a schematic view showing a configuration of an ultra-long stroke multi-cylinder reciprocating pump with three cylinders according to the present disclosure.
Figure 3:
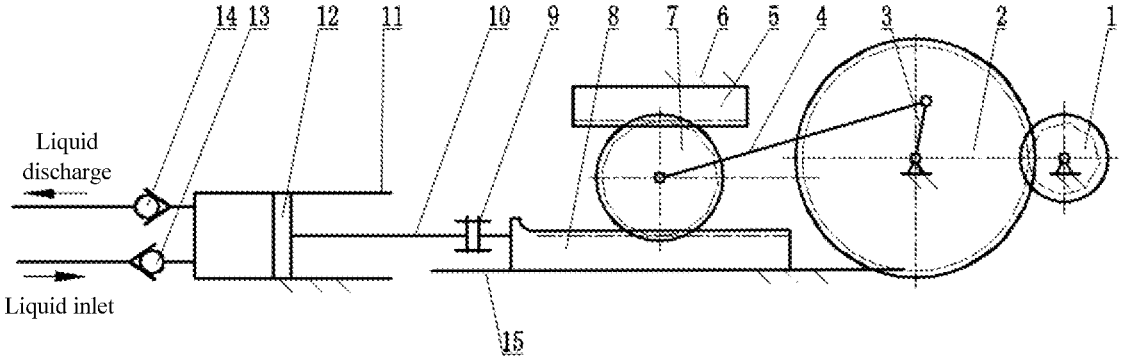
FIG. 3 is a schematic view showing an offset type arrangement of an ultra-long stroke multi-cylinder reciprocating pump according to the present disclosure.
Figure 4:
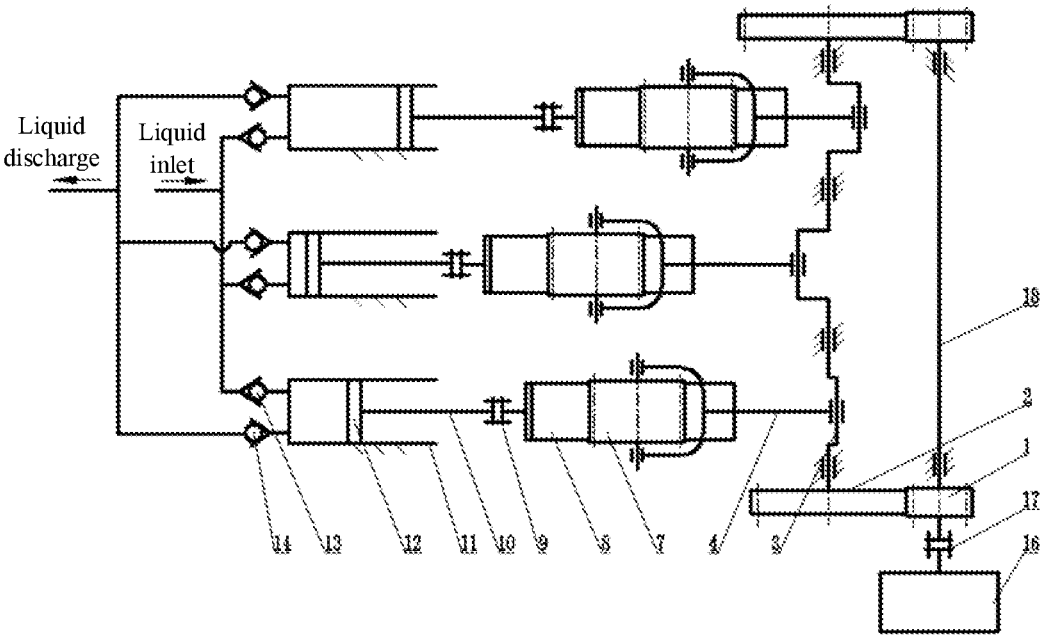
FIG. 4 is a schematic view of an ultra-long stroke multi-cylinder reciprocating pump adopting a U-shaped structural connecting rod according to the present disclosure.

Reference numbers: 1—small gear, 2—large gear, 3—crankshaft, 4—connecting rod, 5—fixed rack, 6—frame, 7—translation pinion, 8—movable rack, 9—clamp, 10—piston rod, 11—cylinder sleeve, 12—piston, 13—suction valve, 14—liquid discharging valve, 15—guide rail, 16—prime motor, 17—coupling, 18—small gear shaft.

DETAILED DESCRIPTION

In order that the objectives, technical solutions, and advantages of the present disclosure will become more distinct, a more particular description of the disclosure will be rendered with reference to the appended drawings and embodiments. It is to be understood that the specific embodiments described herein are merely illustrative of the invention and are not intended to limit the invention, that is, the described embodiments are only a few, but not all embodiments of the present disclosure. The components of the embodiments of the present disclosure, which are generally described and illustrated in the drawings herein, may be arranged and designed in a variety of different configurations.

Accordingly, the following detailed description of embodiments of the present disclosure provided in the accompanying drawings is not intended to limit the scope of the present disclosure as claimed, but is merely representative of selected embodiments of the present disclosure. On the basis of the embodiments of the present disclosure, all other embodiments obtained by a person skilled in the art without involving any creative effort are within the protection scope of the invention.

It should be noted that relational terms such as "upper" and "lower" and the like are used solely to distinguish one entity or operation from another entity or operation without necessarily requiring or implying any such actual relationship or order between such entities or operations. Moreover, the terms "comprising", "containing" or any other variation thereof, are intended to cover a non-exclusive inclusion, such that a process, method, article, or apparatus that includes a list of elements not only includes those elements but may also include other elements not expressly listed or inherent to such process, method, article, or apparatus. An element defined by the phrase "including a" does not, without more constraints, preclude the existence of additional identical elements in the process, method, article, or apparatus that includes the element.

The features and properties of the present disclosure are described in further detail below in conjunction with the embodiments.

Embodiment 1

The embodiment of the present disclosure of an ultra-long stroke multi-cylinder reciprocating pump provides an ultra-long reciprocating pump with three cylinders, which includes a small gear 1, a large gear 2, a crankshaft 3, three connecting rods 4, three fixed racks 5, a frame 6, three translation pinions 7, three movable racks 8, three clamps 9, three piston rods 10, three cylinder sleeves 11, three pistons 12, three suction valves 13, three liquid discharging valves 14, three guide rails 15, a prime motor 16, a coupling 17, and a small gear shaft 18.

The small gear 1 is fixedly mounted on the small gear shaft 18, and the large gear 2 is fixedly mounted on the crankshaft 3. One end of the connecting rod 4 is connected with the crankshaft 3, and the other end of the connecting rod 4 is connected with a rotation center of the translation pinion 7. The fixed rack 5, the guide rail 15 and the cylinder sleeve 11 are all fixed on the frame 6, the movable rack 8 is mounted in the guide rail 15 and movable along the guide rail 15, one end, close to the cylinder sleeve 11, of the movable rack 8 is connected with the piston rod 10 through the clamp 9, the piston rod 10 is fixedly connected with the piston 12, the prime motor 16 is fixed on the frame 6, and an output shaft of the prime motor 16 is connected with the small gear shaft 18 through the coupling 17.

When the prime motor 16 rotates, the small gear shaft 18 and the small gear 1 are driven to rotate, the small gear 1 is meshed with the large gear 2, rotation power of the small gear shaft 18 is decelerated and then transmitted to the large gear 2, the crankshaft 3 is driven to rotate, a rotation center of the translation pinion 7 is driven to move reciprocally through the connecting rod 4, and the translation pinion 7 drives the movable rack 8 and the piston 12 to move reciprocally. When the piston 12 moves towards the opening side of the cylinder sleeve 11, the liquid discharging valve 14 is closed, the suction valve 13 is opened, and liquid enters the cylinder sleeve 11; when the piston 12 moves towards the closing side of the cylinder sleeve 11, the suction valve 13 is closed, the liquid discharging valve 14 is opened, and the liquid is pressurized and then discharged out of the cylinder sleeve 11.

A distance of reciprocating motion of the rotation center of the translation pinion 7 is directly proportional to a radius of the crankshaft 3, and in a centering type arrangement, the distance is twice the radius of the crankshaft 3. When a center of the translation pinion 7 moves, gear teeth on the upper part of the translation pinion 7 are meshed with the fixed rack 5 to form a speed instantaneous center, and an instantaneous speed when a lower portion of the translation pinion 7 is meshed with the movable rack 8 is twice that of the rotation center of the translation pinion 7, so that a distance of reciprocating motion of the movable rack 8 is twice the distance of reciprocating motion of the rotation center of the translation pinion 7. Therefore, a stroke of the piston 12 is four times the radius of the crankshaft 6, so that the stroke of the reciprocating pump reaches an ultra-long stroke that is twice the stroke of a reciprocating pump of a conventional crank connecting rod mechanism with the same crankshaft radius.

The small gear 1 is fixedly mounted at one end of the small gear shaft 18, and the large gear 2 is fixedly mounted at one end of the crankshaft 3 capable of being meshed with the small gear 1; or two small gears 1 are symmetrically and fixedly mounted at both ends of the small gear shaft 18, and two large gears 2 are fixedly mounted at both ends of the crankshaft 3 and respectively meshed with the two small gears 1.

A fixed rack 5 and a movable rack 8 are parallel to each other and are both meshed with a translation pinion 7, and the rotation center of the translation pinion 7 and a rotation center of the crankshaft 3 adopt a centering type arrangement or an offset type arrangement. In the centering type arrangement, a motion track of the rotation center of the translation pinion 7 passes through the rotation center of the crankshaft 3, and in the offset type arrangement, the motion track of the rotation center of the translation pinion 7 deviates from the rotation center of the crankshaft 3 by a certain distance.

The movable rack 8 is parallel to an axis of the cylinder sleeve 11, an axis of the piston rod 10 and the piston 12 coincides with the axis of the cylinder sleeve 11, and a portion of the movable rack 8 connected with the piston rod 10 through the clamp 9 has a cylindrical structure, with its center line coinciding with the axis of the piston rod 10 and lower than a pitch line for meshing with the translation pinion 7.

The translation pinion 7 adopts a dumbbell-shaped structure, where larger diameter parts at both ends are identical straight gears or symmetrically arranged helical gears, and the connecting rod 4 adopts a same structure as that of the reciprocating pump of the conventional crank connecting rod mechanism and is connected with a smaller diameter part in middle of the translation pinion 7.

Alternatively, the translation pinion 7 can adopt an integral cylindrical structure, and a connecting end of the connecting rod 4 with the translation pinion 7 adopts a U-shaped structure.

A plurality of identical cylinder sleeves 11, pistons 12, piston rods 10, clamps 9, movable racks 8, translation pinions 7, fixed racks 5, connecting rods 4, suction valves 13, and liquid discharging valves 14 are used, and the crankshaft 3 is configured into a same number of crank throws, so that the ultra-long stroke multi-cylinder reciprocating pump with double cylinders, three cylinders, five cylinders or more cylinders is formed.

When a double-cylinder pump is adopted, two crank throws of the crankshaft 3 are configured with a 180° phase angle; when a three-cylinder pump is adopted, three crank throws of the crankshaft 3 are configured with a 120° phase angle; when a five-cylinder pump is adopted, five crank throws of the crankshaft 3 are configured with a 72° phase angle; and so on.

The prime motor 16 may be an electric motor or a diesel or hydraulic motor.

The description above is only one embodiment of the present disclosure and is not intended to limit the present disclosure. It is intended that the protection scope of the present disclosure covers the modifications, equivalents and variations of this disclosure provided they come within the spirit and scope of this disclosure.

What is claimed is:

1. An ultra-long stroke multi-cylinder reciprocating pump, comprising:

a small gear, a large gear, a crankshaft, connecting rods, fixed racks, a frame, translation pinions, movable racks, clamps, piston rods, cylinder sleeves, pistons, suction valves, liquid discharging valves, guide rails, a prime motor, a coupling, and a small gear shaft;

wherein the small gear is fixedly mounted on the small gear shaft, the large gear is fixedly mounted on the crankshaft, one end of the connecting rod is connected with the crankshaft, the other end of the connecting rod is connected with a rotation center of the translation pinion, the fixed rack, the guide rail and the cylinder sleeve are all fixed on the frame, the movable rack is mounted in the guide rail and movable along the guide rail, one end, close to the cylinder sleeve, of the movable rack is connected with the piston rod through the clamp, the piston rod is fixedly connected with the piston, the prime motor is fixed on the frame, and an output shaft of the prime motor is connected with the small gear shaft through the coupling;

wherein when the prime motor rotates, the small gear shaft and the small gear are driven to rotate, the small gear is meshed with the large gear, rotation power of the small gear shaft is decelerated and then transmitted to the large gear, the crankshaft is driven to rotate, the rotation center of the translation pinion is driven to move reciprocally through the connecting rod, and the translation pinion drives the movable rack and the piston to move reciprocally;

wherein when the piston moves towards the opening side of the cylinder sleeve, the liquid discharging valve is closed, the suction valve is opened, and liquid enters the cylinder sleeve;

wherein when the piston moves towards the closing side of the cylinder sleeve, the suction valve is closed, the liquid discharging valve is opened, and the liquid is pressurized and then discharged out of the cylinder sleeve;

wherein a distance of reciprocating motion of the rotation center of the translation pinion is directly proportional to a radius of the crankshaft, and in a centering type arrangement, the distance is twice the radius of the crankshaft;

wherein when the rotation center of the translation pinion moves, gear teeth on the upper part of the translation pinion is meshed with the fixed rack to form a speed instantaneous center, and an instantaneous speed when a lower portion of the translation pinion is meshed with the movable rack is twice that of the rotation center of the translation pinion, so that a distance of reciprocating motion of the movable rack is twice the distance of reciprocating motion of the rotation center of the translation pinion;

therefore, a stroke of the piston is four times the radius of the crankshaft, so that a stroke of the reciprocating pump reaches an ultra-long stroke that is twice the stroke of a reciprocating pump of a conventional crank connecting rod mechanism with the same radius of crankshaft.

2. The ultra-long stroke multi-cylinder reciprocating pump according to claim 1, wherein the small gear is fixedly mounted at one end of the small gear shaft, and the large gear is fixedly mounted at one end of the crankshaft capable of being meshed with the small gear; or two small gears are symmetrically and fixedly mounted at both ends of the small gear shaft, and two large gears are fixedly mounted at both ends of the crankshaft and respectively meshed with the two small gears.

3. The ultra-long stroke multi-cylinder reciprocating pump according to claim 1, wherein a fixed rack and a movable rack are parallel to each other and are both meshed with a translation pinion, and the rotation center of the translation pinion and a rotation center of the crankshaft adopt a centering type arrangement or an offset type arrangement; in the centering type arrangement, a motion track of the rotation center of the translation pinion passes through the rotation center of the crankshaft; in the offset type arrangement, the motion track of the rotation center of the translation pinion deviates from the rotation center of the crankshaft by a certain distance.

4. The ultra-long stroke multi-cylinder reciprocating pump according to claim 1, wherein the movable rack is parallel to an axis of the cylinder sleeve, an axis of the piston rod and the piston coincides with the axis of the cylinder sleeve, and a portion of the movable rack connected with the piston rod through the clamp has a cylindrical structure, with its center line coinciding with the axis of the piston rod and lower than its pitch line for meshing with the translation pinion.

5. The ultra-long stroke multi-cylinder reciprocating pump according to claim 1, wherein the translation pinion adopts a dumbbell-shaped structure, wherein larger diameter parts at both ends are identical straight gears or symmetrically arranged helical gears, and the connecting rod adopts a same structure as that of the reciprocating pump of the conventional crank connecting rod mechanism and is connected with a smaller diameter part in middle of the translation pinion.

6. The ultra-long stroke multi-cylinder reciprocating pump according to claim 1, wherein the translation pinion adopts an integral cylindrical structure, and a connecting end of the connecting rod with the translation pinion adopts a U-shaped structure.

7. The ultra-long stroke multi-cylinder reciprocating pump according to claim 1, wherein a plurality of identical cylinder sleeves, pistons, piston rods, clamps, movable racks, translation pinions, fixed racks, connecting rods, suction valves and liquid discharging valves are used, and the crankshaft is configured into a same number of crank throws, so that the ultra-long stroke multi-cylinder reciprocating pump with double cylinders, three cylinders, five cylinders or more cylinders is formed.

8. The ultra-long stroke multi-cylinder reciprocating pump according to claim 1, wherein when a double-cylinder pump is adopted, two crank throws of the crankshaft are configured with a 180° phase angle; when a three-cylinder pump is adopted, three crank throws of the crankshaft are configured with a 120° phase angle; when a five-cylinder pump is adopted, five crank throws of the crankshaft are configured with a 72° phase angle; and so on.

9. The ultra-long stroke multi-cylinder reciprocating pump according to claim 1, wherein the prime motor is an electric motor or a diesel or hydraulic motor.

* * * * *